United States Patent [19]

Davenport

[11] Patent Number: 4,465,274

[45] Date of Patent: Aug. 14, 1984

[54] HYDRAULIC EXERCISE DEVICE

[76] Inventor: Dennis L. Davenport, 10 E. 200 South, American Fork, Utah 84003

[21] Appl. No.: 424,320

[22] Filed: Sep. 27, 1982

[51] Int. Cl.[3] ..... A63B 21/00

[52] U.S. Cl. ..... 272/130; 272/134

[58] Field of Search ..... 272/130, 134, 93, 129

[56] References Cited

U.S. PATENT DOCUMENTS

| | | | |
|---|---|---|---|
| D. 242,732 | 12/1976 | Brentham | 272/130 X |
| 1,598,940 | 9/1926 | Smith | 272/72 |
| 2,068,578 | 1/1937 | Stronach | 272/130 |
| 3,128,094 | 4/1964 | Wolf | 272/130 |
| 3,495,824 | 2/1970 | Cuinier | 272/130 |
| 3,638,941 | 2/1972 | Kulkens | 272/130 |
| 3,822,599 | 7/1974 | Brentham | 272/130 |
| 3,912,865 | 10/1975 | Muir | 272/130 |
| 4,072,309 | 2/1978 | Wilson | 272/136 |
| 4,183,520 | 1/1980 | Chase | 272/134 |
| 4,240,627 | 12/1980 | Brentham | 272/134 |
| 4,241,913 | 12/1980 | Zwayer | 272/130 |
| 4,275,882 | 6/1981 | Grosser | 272/130 X |
| 4,353,547 | 10/1982 | Jenkinson | 272/134 |
| 4,357,010 | 11/1982 | Tele | 272/130 |
| 4,397,462 | 8/1983 | Wilmarth | 272/130 |

FOREIGN PATENT DOCUMENTS

| | | | |
|---|---|---|---|
| 59426 | 2/1975 | Australia | 272/130 |

OTHER PUBLICATIONS

Athletic Journal, Nov. 1982, Inside Cover Page, Advertisement of Keiser Sports Health Equip., Fresno, CA.

Power Max advertisement in Muscle Digest, Sep. 1982.

Soloflex advertisement in Newsweek Mag., Aug. 30, 1982.

*Primary Examiner*—Richard J. Johnson

*Attorney, Agent, or Firm*—M. Reid Russell; Robert R. Mallinckrodt

[57] ABSTRACT

A hydraulic exercise device that includes an upstanding mast whereon a number of fixed and movable exercise portions for simultaneous and sequential operation are provided, each utilizing an isotonic load system as a load resistance against which exercises are performed, whereby, a bodybuilder at a single station, can exercise all the major muscle groups of his body.

13 Claims, 6 Drawing Figures

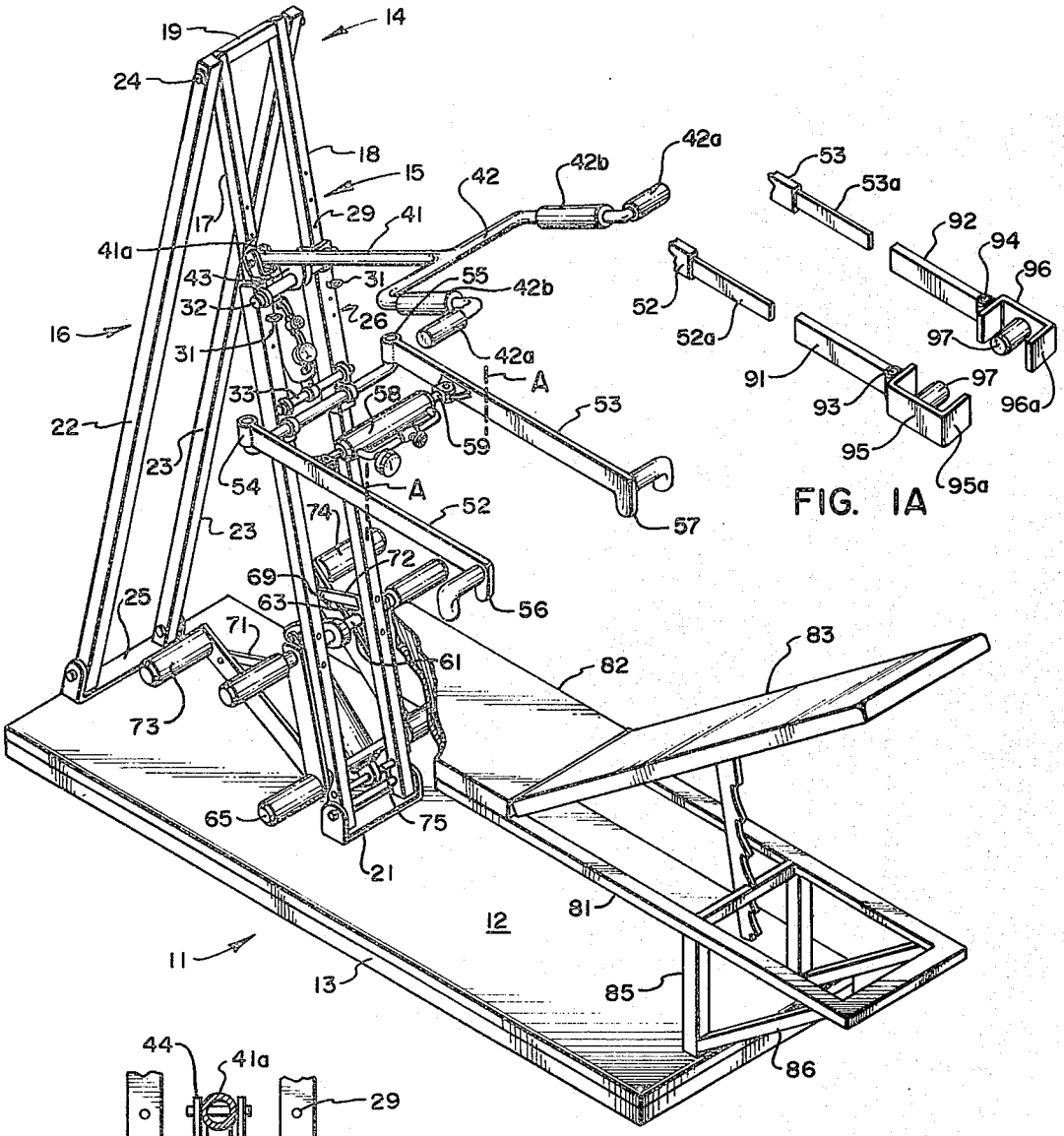
FIG. 1
FIG. 1A
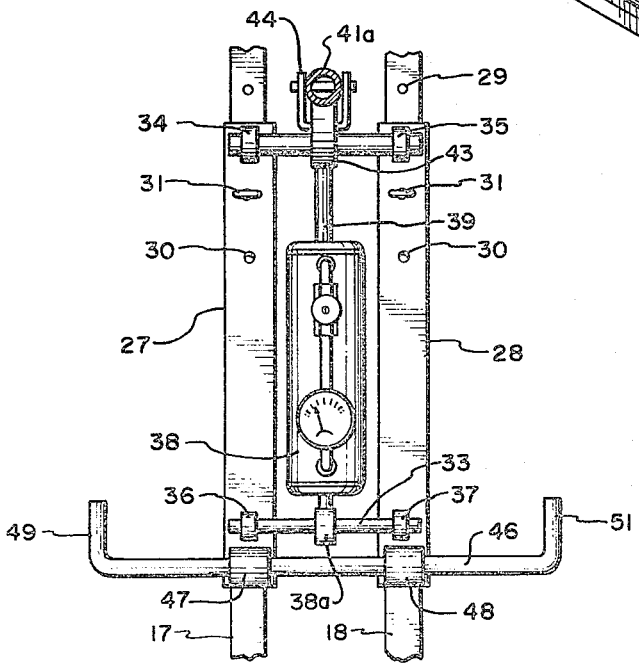
FIG. 2
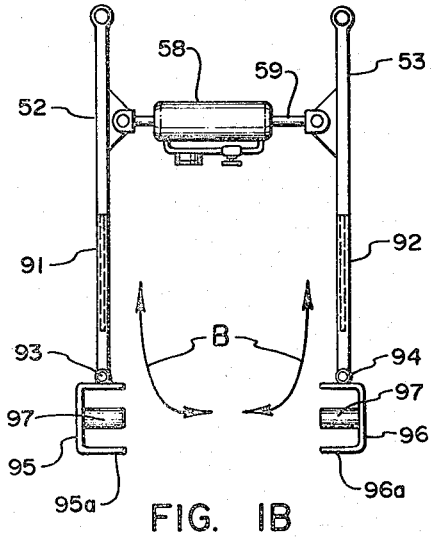
FIG. 1B

HYDRAULIC EXERCISE DEVICE

BACKGROUND OF THE INVENTION

1. Field

The invention is in the field of hydraulic exercise devices where an operator from a single bench or seat can exercise a number of different muscle groups.

2. State of the Art

Exercise devices of various types have been proposed to utilize handlebars, pedals and the like, all of which are moved against some load, such as generated by static or moving weights, springs, friction, and pneumatic or hydraulic arrangements. Such devices generally vary in size and complexity according to the number of different exercises which can be performed with them, and may be arranged to isolate a muscle group to be exercised, as for example machines commonly identified with the mark Nautilus. Also, in addition to being far more complicated than the present invention and having less capabilities for exercise of a number of muscle groups, earlier devices have generally been subject to inertia effect where weight movement acts against the exercise. Unique therefrom, the present invention provides an isotonic system where the load or resistance is directly proportional to the force exerted by a bodybuilder pushing against the system, providing a uniform resistance that will stop when the bodybuilder ceases to exert muscle force thereagainst.

A number of earlier devices have incorporated a handlebar that is movable in a vertical plane against load to perform exercises such as presses of various types, pulls, raises and squats. Such have not, however, included a common bench or stand, nor have they included other chest exercise mechanisms to provide resistance to lateral movement, as a pectoral or fly chest exercise machine, or a leg extension exercise device. The present invention provides these multiple exercise capabilities all with isotonic load systems, and all on a single upright frame where all the systems can be operated from a same bench. Most earlier exercise devices have provided for one type of exercise mechanism and only where devices that have provided for multiple types of exercises to be performed they have generally been complex and expensive and have involved a number of separate stations or positions. Prior to the present invention, none have included the multiple exercise devices on a single frame that utilize an isotonic loading system to provide a continuous resistive force throughout each exercise that is governed by the force applied thereagainst by a bodybuilder for maximum body building benefit.

SUMMARY OF THE INVENTION

The present invention in a hydraulic exercise device provides individual hydraulic loops as isotonic load sources for component exercise systems arranged on a common upright frame. The frame can be collapsible to facilitate handling and storage. The exercise device includes a platform whereto is supported a light, sturdy upright frame. The frame can be supported to the platform, can be arranged for connection to an upright wall, or alternatively can be pivotally connected to the platform to collapse for storage and transport. The frame includes a mast that includes parallel supports with a web or lattis secured therebetween. A plurality of mechanisms for performing different types of exercises are serially supported on the mast and are, in part, movable vertically thereon to accommodate users of various sizes. A bench is arranged on said platform in front of the mast whereon a person can rest to perform bodybuilding exercises with the mechanisms. The mechanisms each include, as an isotonic load source, a closed loop hyraulic system that includes an adjustable flow resistance therein for setting a desired load. Each hydraulic loop includes a piston moved within a cylinder against a hydraulic fluid by operation by a person performing exercises with the device.

DRAWINGS

The best mode presently contemplated of carrying out the invention will be understood from the detailed description of the preferred embodiment illustrated in the accompanying drawings in which:

FIG. 1 is a perspective view of the exercise device with an associated bench;

FIG. 1A is a profile perspective view of a pair of arms for performing "fly" exercises for telescoping, at broken lines A, over arms of a chest exercise portion of the exercise device of FIG. 1.

FIG. 1B is a top plan schematic of the "fly" exercise portion of FIG. 1A showing, with arrows B, the operation thereof;

FIG. 2 is an elevation view at an enlarged scale of a portion of a mast and head of FIG. 1;

DETAILED DESCRIPTION OF THE ILLUSTRATED EMBODIMENTS

Figure 3:
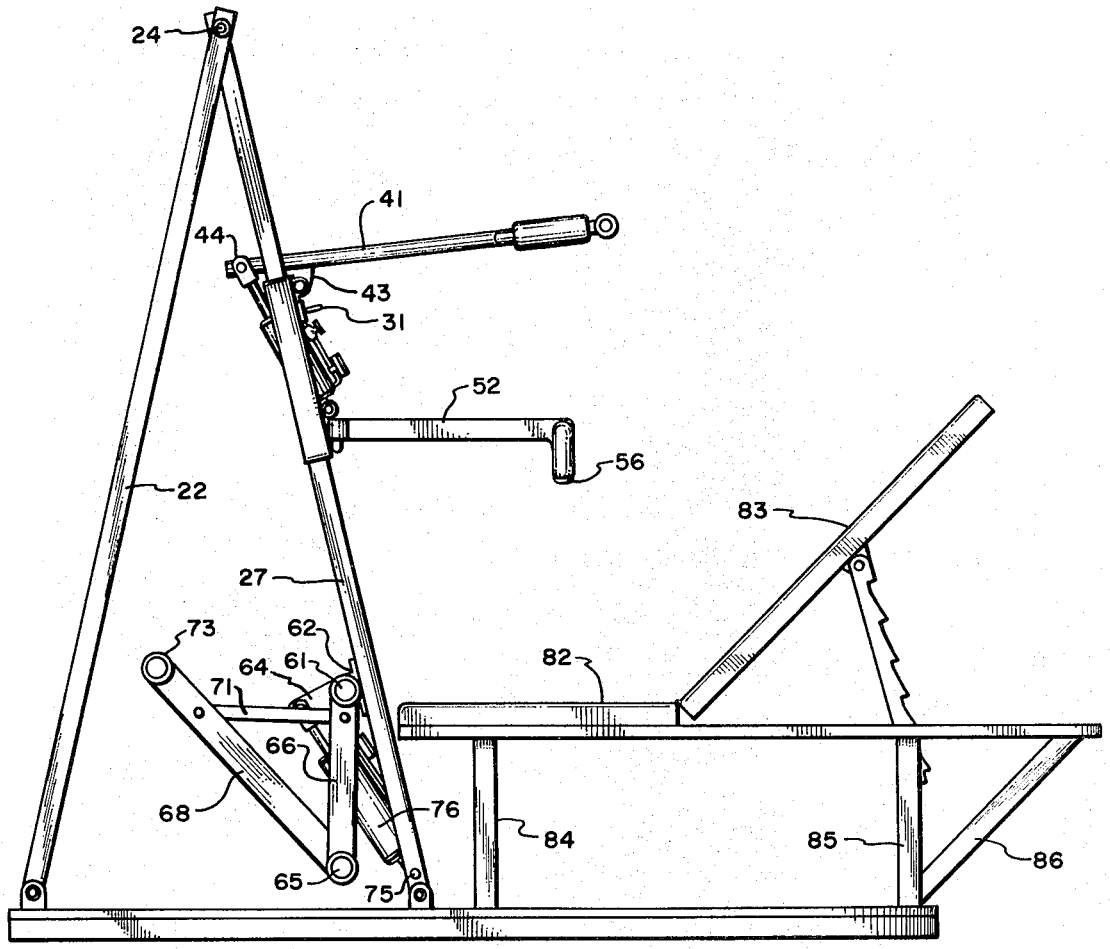
FIG. 3 is a side view of the exerciser.

As shown in FIG. 1, the hydraulic exercise device of the present invention hereinafter referred to as exercise device, includes a base 11 formed of a rectangular platform 12 that is preferably constructed of a suitable rigid material, such as plywood, chipboard, or the like, and is secured to the upper surface of a support 13. Attached to the upper surface of the platform 12 is shown an upright frame 14. The frame includes a load-bearing mast 15 and a connected brace 16. The mast is made up of two elongated, parallel posts 17 and 18 which are selected to be capable of withstanding substantial compressive forces without buckling or distortion. The posts 17 and 18 are essentially parallel and are spaced apart and connect at their upper ends to a spacer 19. The lower ends of the posts are bolted or otherwise detachably secured to a shallow U-shaped fixture 21 which is secured to the upper surface of the platform near the center thereof. The brace 16 is preferably formed of two parallel poles 22 and 23. The pole upper ends are connected to the spacer 19, such as by installation of a bolt 24 laterally through pole 22, longitudinally through the spacer 19 and laterally through pole 23, with of a nut or like fastener installed thereon. So arranged, the spacer can be rotated about its longitudinal axis, providing a hinged connection between the brace and the mast 15. The lower ends of poles 22 and 23 are in turn, pivotally attached to a U-shaped fixture 25 that is secured to the platform. The U-shaped fixture 25 is preferably located on the edge of the one end of the platform at the approximate midpoint. The U-shaped fixture 25 is thus spaced from the shallow U-shaped fixture 21 approximately one-half of the length of the platform and the mast 15 and the brace 16 will thereby appear as sides of a triangle when viewed from the side, with the length of the triangle base the distance between the shallow U-shaped fixture 21 and U-shaped fixture 25. So arranged, the upright frame 14 will be stable in the horizontal plane.

Referring to FIGS. 1 and 2, a vertical lift portion of the exercise device is shown as included in a head 26 that is mounted between the mast posts 17 and 18 to be vertically movable to adjust its position relative to the platform. The head consists of two short tubular sections 27 and 28 that are dimensioned to telescope over the posts 17 and 18 to serve as slide extensions or supports for the head. Spaced openings 29 are provided at regular intervals in the posts 17 and 18, with similar openings 30 are provided in the tubular sections. So arranged, the housing can be moved to a desired location on the mast where openings 30 are aligned with openings 29 to receive locking pins 31, inserted therein, locking the head thereon. The head 26 includes with the tubular sections cross rods 32 and 33 that are connected respectively, to the tubular sections upper and lower ends. The rods 32 and 33 are retained in place by semicircular clamps 34, 35, 36 and 37 which are welded or otherwise secured to the tubular sections forming a rigid frame that is movable vertically whereto, the vertical lift portion of the exercise device is mounted. The vertical lift portion includes as a hydraulic system, an hydraulic loop that consists of a cylinder asembly 38 that is positioned between the tubular sections with its lower end at **38*a* journaled to cross rod 33. A piston rod 39 extends from the upper end of the cylinder assembly that pivotally connects at a U-coupling 44 end to end 41*a* of an elongated lever 41. The opposite elongated lever end has a handlebar 42 attached thereto and includes a cylindrical bearing 43 that is spaced a short distance from the U-coupling 44. The elongated lever 41 is, in turn, pivotally mounted to cross rod 32 in the head 26 between the upper ends of the tubular sections 27 and 28 at a pivot 43, a cylindrical bearing fitted therein journaled through the cross rod 32 with limits of vertical travel of lever arm 41 governed by travel of the piston rod 39**.

As will be set out in detail later herein with reference to FIG. 4, movement of piston rod 39 in and out of cylinder assembly 38 is opposed by resistance of a fluid to being pumped through a constriction, providing an isotontic system where the resistance or load that is present is directly proportional to the force a bodybuilder applies to move the fluid through the constriction. The size of which constriction can be adjusted to provide a load adjustment.

A bench is provided with the exercise device that includes a frame 81, a seat 82, an adjustable inclined backrest 83 hinged to the seat, and front and rear bench legs 84 and 85. The seat extends beyond the front legs 84 to a position below the handlebar 42 and above shallow U-shaped fixture 21. The distance between the front and rear bench legs is selected such that all the legs will rest upon the platform when the bench is in the using position. So arranged, the backrest extends well beyond the rear legs and is supported from the rear legs by means of a prop 86.

As shown in FIG. 1, with the head 26 moved and locked to where the handlebar 42 is above the bench, a bodybuilder sitting, on seat 82 in front of mast 15 can position himself thereunder, to grip, in his hands, the handlebar ends **42*a*. So arranged, the vertical lift portion of the exercise device is used as a bench press, providing resistance or load to up and down vertical movement. In this attitude, or by moving the head 26 closer to the bench and locking the position rod 39 in place, as will be explained later herein, and lowering the backrest 83 to the plane of the seat 82, a body builder can hook his toes under the handlebar ends to do situps on the bench or, by hanging his arms over the backrest end or sides he can lift a bar weight or dumbbells over his head. At or near a same head 26 position just above the bench, with the hydraulic loop arranged to resist piston rod 39** movement, a bodybuilder straddling the bench, gripping the handlebar ends can pull up on the handle bar to do vertical dead lifts and rowing exercises.

By appropriate repositioning of the head 26 above the bench to where a bodybuilder seated on the bench can reach upward to grip the handlebar ends **42*a*, the exercise device can be used as a lat machine, the bodybuilder pulling down on the handlebar ends, and will provide an overhead lift exercise when the bodybuilder pushes the handlebar ends upwardly. With a readjustment of the head 26 relative to the bench, as needed, a bodybuilder lying on his back with his legs flexed and under the handlebars can position his feet against the handlebar ends 42*a*. Thereafter, by moving the feet vertically, a bodybuilder can exercise his thighs, which movement is facilitated by maintaining the feet to the handlebar ends by straps, or the like, not shown. Similarly, for exercising the lower back and calf muscles, with pads 42*b* installed over the handlebar parallel sides, the bodybuilder straddling the bench and placing his shoulders beneath and against the pads can perform squat and standing calf exercises. Then, by elevating and locking head 26 appropriately on mast 15, and locking piston rod 39** in place, the bodybuilder can hang from the handlebar to do chest and neck raises and hanging knee raises.

Set out above are only some of the exercises that can be performed utilizing the vertical lift portion of the exercise device. Additional to the vertical lift portion the exercise device can include a chest or pec exercise portion that is releasably connected to head 26 to be movable therewith that, shown in FIG. 2, includes a bar 46 secured to the head, adjacent to rod 33 by means of bearings 47 and 48. The bar 46 extends laterally from the head, protruding therebeyond at both sides. The ends of the bar 46 are bent equally approximately normal to the axis of the bar to form studs 49 and 51 that, as shown in FIG. 1, receive identical arms 52 and 53 fitted thereon. Each arm is provided at an end with a socket 54 and 55 that is adapted to be received on the studs. The bar 46 is thereby free to rotate on the bearings 47 and 48 and the arms 52 and 53 are journaled on sockets 54 and 55 to move across the head. The arms are thus capable of movement in two mutually perpendicular planes. Generally U-shaped handles 56 and 57 are secured on the ends of the arms for gripping by a bodybuilder. A resistance to movement or load is provided by a hydraulic loop that includes hydraulic cylinder assembly 58 that is connected between the arms 52 and 53 adjacent the sockets 54 and 55. The end of the hydraulic cylinder is attached to one arm, with the end of a piston rod 59 that extends therefrom attached to the other arm. In operation, a bodybuilder sitting on the bench seat 82 in front of the mast 15 after adjustment of the head 26 positioning, grips, in each hand, the handles 56 and 57 and moves them back and forth across his chest, the hydraulic loop providing resistance or load in both directions of travel. Thereby, the bodybuilder seated on the same bench seat 82 in front of mast 15 can sequentially operate the above described vertical lift and chest exerciser portions of the exercise device. Also, the bodybuilder laying on the seat 82 can position his feet against the handles 56 and 57 to perform a scissor-like exercise involving opening and closing his legs, the hydraulic loop providing resistance or load against leg travel.

At vertical broken lines A in FIG. 1, the arms 52 and 53 are shown as being split apart to expose, as shown in FIG. 1A, slide rods 52*a* and 53*a*. When so arranged, the ends of arm 52 and 53 can be removed and reinstalled and locked in place for use as described above. Additionally, the slide rods, as shown, are also arranged to receive sliding arms 91 and 92 telescoped thereover. The sliding arms are arranged to travel back and forth on the slide rods during a practice of "fly" type exercises therewith as will be explained herein below. As needed, tracks, bearings, or the like not shown, can be included to facilitate such back and forth movement and releasable stops, not shown, can be provided to limit outward sliding arm travel. Ends of each sliding arm include pivot bearings 93 and 94 that each attach to a U-shape grip housing 95 and 96. Each grip housing includes a hand grip 97 for gripping by a bodybuilder in performing a "fly" exercise as set out below.

In operation, to perform a "fly" exercise, a bodybuilder seated on bench 82 with his back to mast 15, his hands aligned and slightly above shoulder level, his arms parallel, he holds each hand grip 97. The bodybuilder then moves his hands and arms around his shoulders, the hands pivoting such that leading faces 95*a* and 96*a* of the U-shaped grip housing come into contact in front of the bodybuilder's face, as illustrated by arrows B in the schematic of FIG. 1B. Arrows B are double headed to illustrate both a forward and rearward movement of sliding arms 91 and 92 and a together and apart movement of U-shaped grip housings 95 and 96, the housings pivoting on pivot bearings 93 and 94. So operated, the hydraulic cylinder 58 and piston rod 59, as set out above, provide a resistance to travel in the plane of the bodybuilder's chest. A bodybuilder exercising the above described fly exercise portion of the exercise devices can thereby exercise his chest and back muscles.

As set out below, simultaneous with operation of either the vertical lift, chest or "fly" exercise portions of the exercise device, a bodybuilder can also operate a leg exerciser portion of the device.

FIGS. 1 and 3 show a preferred leg exerciser portion of the exercise device to include a horizontal bar 61 which is supported in bearings 62 and 63 that are aligned and secured to the posts 17 and 18. A cantilever 64 is welded to the bar 61 at its approximate mid-length to extend radially of the arm rearwardly toward the brace 16. A second horizontal bar 65 is suspended from bar 61 by means of vertical parallel struts 66 that extend radially from opposite end portions of bar 61. The bars 61 and 65 are approximately the same length and the vertical struts are welded to each at points spaced inwardly from the free ends. The free ends of each bar are appropriately padded or are provided with cylindrical rollers for bearing surfaces against which a bodybuilder positions his ankles. A pair of arms 68 and 69 extend rearwardly and upwardly from the bar 65 that are connected to struts 66 by horizontal struts 71 and 72. Pedals 73 and 74 are attached to extend in opposite directions from the distal ends of the arms 68 and 69 and are coextensive with the free ends of the bars 61 and 65. A rod 75 is connected between the lower ends of the posts 17 and 18. An hydraulic loop, including a hydraulic cylinder 76, is journaled on one end to approximately a midpoint of a rod 75 that is secured between the posts 17 and 18, and a piston rod 77 extends from the upper end of the hydraulic cylinder and is pivotally attached on its end to the distal end of the cantilever 64.

The leg exerciser can be used to perform leg extensions by a bodybuilder sitting on the bench 82 who positions the free ends of the bar 61 behind his knees, and engages his insteps below the free ends of bar 65 and then extends his legs. When bar 65 is elevated or lowered, bar 61 rotates therewith causing cantilever 64 to lower or raise piston rod 77 within hydraulic cylinder assembly 76. Leg curls can be performed by the bodybuilder lying face down on the bench with his knees on the free ends of bar 61 and the heels engaging pedals 73 and 74. Thereby, the bodybuilder pulling his heels towards his thighs, flexes his knees, raising the pedals and rotating bar 61 to raise piston rod 77. When his knees are fully flexed, the bodybuilder disengages his heels and engages his insteps to the pedals. The legs are then extended to move the pedals downwardly against the back-pressure in the hydraulic loop.

Figure 4:
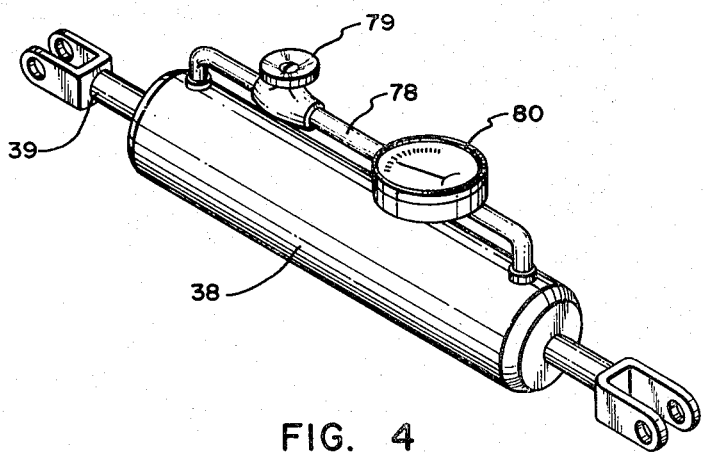
FIG. 4 is an elevation view of the hydraulic loop assembly of the present invention.

Shown in FIG. 4, is a hydraulic loop that includes a hydraulic cylinder 38 which is filled with a suitable hydraulic fluid. The hydraulic cylinder and piston rod 39 and the other components of the hydraulic loop as described hereinbelow, should be understood, are identical for each portion of the exercise device. A piston, not shown, is positioned in the hydraulic cylinder and is attached to piston rod 39 that extends outwardly from one end thereof. A tube 78 is connected into the opposite ends of the hydraulic cylinder to serve as bypass for the passage of fluid from one side of the piston to the other. A constriction arrangement, preferably a needle valve 79, is connected in the tube to restrict and control the rate of fluid flow through the tube. A back-mounted pressure gauge 80 is preferably connected to the tube adjacent the end of the hydraulic cylinder, removed from the piston rod, which gauge is calibrated in pounds or other appropriate units of pressure. The needle valve is capable of very fine adjustment which permits the bypass tube to be of relatively small diameter. By adjusting the valve to restrict the area of the passageway through the valve, a maximum rate of fluid flow through the valve can be selected. Movement of the piston and piston rod is resisted by the back-pressure created by the restriction in the bypass tube, and it is this back-pressure that is the force or load against which the bodybuilder works, which load is displayed on the gauge for observation by the user. Optionally, two such pressure gauges can be arranged above and below the needle valve, for indicating pressure in either direction of piston rod travel. For any given setting of the needle valve, the amount of back-pressure will be a function of the rate at which the lever, arms or bars are moved.

In the operation, as set out above, a bodybuilder sitting or laying on the bench seat 82, in front of or with his back to mast 15 can operate all the described portions of the exercise device, individually and in some cases together. Such operations include, as needed, adjustment of the head 26 to the desired height for the user and the particular exercise to be performed. When the handlebar 24 needs to be in proximity to the top of the bench, the arms 52 and 53 of the chest exercise portion can be lifted out of sockets 54 and 55 allowing the head to travel into close proximity to seat 81. After positioning of head at a desired position on mast 15, the locking pins 31 are inserted in the aligned openings 30 and 29 to lock the head at that desired position.

For operation of any of the described exercise portions, the needle valve 79 setting for each hydraulic loop is adjusted to select the rate of fluid displacement desired for each exercise. By way of example, for chin ups, the housing is positioned near the upper extremity of the mast 15, the lever is moved to approximately horizontal and the needle valve 79 is closed. For aerobic exercises, the head is moved to an intermediate position and the needle valve is opened to allow nearly an unrestricted flow of fluid through the bypass tube. In the typical situation of operation of the vertical lift portion, when the handlebar 42 is raised, the piston rod 39 and the piston are forced into the hydraulic cylinder. The fluid below the piston will thereby be forced into the bypass tube to flow through the needle valve and into the top of the cylinder above the piston. If the needle valve is partially closed, it creates a restriction in the bypass tube and the corresponding back-pressure will be registered on the gauge 80. When the handlebar is lowered, the piston rod and piston will be raised within the hydraulic cylinder below the piston. If the setting of the needle valve remains the same, the back-pressure on the return sequence or downward movement will be the same as during the extension or upward movement if the rate of movement of the handlebar is the same. The single gauge will not register the back-pressure on the return sequence. The needle valve permits fine adjustment of the restriction, so that the back-pressure can be varied in small increments. The particular setting required is determined by the amount of resistance desired and the type of exercise being performed. A given setting may provide an intermediate amount of back-pressure for a "power exercise" and a much larger back-pressure for a "jerk". The hydraulic loop thereby functions as an isotonic system, providing resistance or load only when energy is being put into the system, without inertia effects that are experienced with moving weights, springs, or a back pressure in a pneumatic system. The system thereby provides a steady load during each cycle and each cycle can be interrupted at any time without concern. As soon as pressure is removed from a piston rod, the back-pressure drops to essentially zero and will drift through the return sequence by its own weight. Operation of the hydraulic loops of the other exercise portions are like that described above except as to the mechanical arrangement whose travel moves the piston rod in and out of the hydraulic cylinder.

For storage or handling the posts 17 and 18 are disengaged from the shallow U-shaped fixture 21 by removing the bolts. The needle valves on the hydraulic cylinders are opened and the elongated lever 41 and connected piston rod is raised to its limit. Arms 52 and 53 are pivoted to the vertical position or lifted from sockets 54 and 55 of bar 46. The horizontal struts 71 and 72 that are bolted to the arms 68 and 69 and to struts 66 and are each disengaged at one end. The arms 68 and 69 are then pivoted about the connection to bar 65 and collapsed to contact bar 61. The members are then pivoted about bolt 24 toward the brace and are received between the poles until bar 61 contacts the poles 22 and 23. The frame 14 is then pivoted about the connection between the poles and U-shaped fixture 25 until it rests flat against the platform 12. In this position, the arms 68 and 69 and the pedals 73 and 74 rest alongside the brace 16. The entire exerciser is thereby collapsed to occupy a space as wide as the platform, as long as the brace, and, with the bench removed, is as high as the combined thickness of the base, bar 61 and the brace.

While the frame 14 has been illustrated as mounted on a separate base 11, it should be understood that, for permanent installations, the base can be dispensed with. In such cases, a floor will serve as the platform with U-shaped fixture 25 secured to the floor adjacent a wall or to the wall itself, and shallow U-shaped fixture 21 secured to the floor at a point removed from the wall. The exercise device can then be collapsed for storage by disengaging the posts 17 and 18 from shallow U-shaped fixture 21, following the same procedure as recited above, and then pivoting the frame 14 until it lies flat against the wall. Alternatively, for installations having a high frequency of use, the brace can be dispensed with and the upper end of the mast secured to the wall itself.

The posts 17 and 18, spacer 19, poles 22 and 23, support 13 and bench frame 81 are preferably formed of a light, strong material that is capable of resisting distortion and deformation under compressive and tensile loads. Tubes of various shapes of materials, such as aluminum, steel, etc. are suitable. It is presently contemplated that the frame 14 could be constructed of square steel tubing approximately 1½ inches square. The tubular sections 27 and 28 can be made of similar material with an inside dimension slightly greater than the outside dimension of the members.

While the invention and its uses have been described with reference to preferred embodiments, it should be realized that various changes may be made and other exercises performed without departing from the disclosed inventive subject matter particularly pointed out and claimed hereinbelow.

I claim:

1. A hydraulic exercise device comprising, a load-bearing mast means adapted to be secured to a supporting surface; a head arranged on said mast for axial travel therealong, means for locking said head in place on said mast means and a closed hydraulic loop resistance means arranged therewith that includes a cylinder secured to said head, a piston rod and connected piston for movement against a contained fluid that includes adjustable flow restriction means therewith; handlebar means arranged to be vertically pivotally movable on said head and is connected to said piston rod to translate that vertical movement into piston movement against said contained fluid; and laterally spaced mounting means secured to said head releasably attaching a chest exercise portion for operation by a bodybuilder comprising a pair of outstanding arms arranged to be gripped and moved apart and back together in a generally horizontal plane by a bodybuilder, said arms being connected to respective ends of a piston cylinder assembly comprising a closed hydraulic loop means providing a controlled resistance to that arm movement.

2. A hydraulic device as set forth in claim 1 further including, with the mast means, a leg exerciser portion for operation by a bodybuilder on a bench means that includes a hydraulic loop means arranged to provide a resistance to axial pivoting of a bar means that is pivotally coupled to said mast means and whereto foot engaging means are secured to be pivoted by a bodybuilder on said bench means.

3. A hydraulic exercise device as set forth in claim 1 or 2, wherein the hydraulic loop means includes a cylinder assembly wherein is contained the piston arranged for back and forth longitudinal travel by the connected piston rod, against a fluid contained therein, and including fluid passage means where through said fluid is displaced from said moving piston face to below said piston moving face.

4. A hydraulic exercise device as set forth in claim 3 wherein the fluid passage means is a tube whose ends connect to the cylinder assembly between the piston travel and includes the adjustable flow restriction means therein.

5. A hydraulic exercise device as set forth in claim 4 wherein the adjustable flow restriction means is a needle valve, and a gauge is connected into the tube for reading the line pressure in one direction of flow, which gauge is calibrated to indicate load in pounds.

6. A hydraulic exercise device as recited in claim 1, further including, sliding arms; hand grip means for coupling to ends of said sliding arms; and pivot means for pivotally coupling each said hand grip means to each said sliding arm end.

7. A hydraulic exercise device as recited in claim 2, wherein leg exercise portion includes, a post that is connected to the support surface to support the pivoting of the bar means; an arm that is fixed to said bar means to extend normal thereto; and the hydraulic loop means connects between the arm and the post to provide a resistance to rotation of said bar means.

8. A hydraulic exercise device as recited in claim 7 wherein the leg exercise portion includes, a first pair of oppositely projecting members supported on said bar means in proximity to the post; and a second pair of oppositely projecting members supported from the bar means, in a spaced relation to said first pair, said second pair of oppositely projecting members being separated from each other.

9. A hydraulic exercise device as set forth in claim 1 wherein, the handlebar means is arranged to provide spaced apart grips between an open center area wherethrough a bodybuilder's head can pass, the bodybuilder's shoulders to contact opposite sides of the handlebar means and including padding means for arrangement between the bodybuilder's shoulders and said handlebar means.

10. A hydraulic exercise device as set forth in claim 1, wherein, the mast means is part of a collapsible frame and includes two upright parallel posts that are spaced apart and are pivotally connected at an apex, as one side of a triangle with a brace as the other side, detachably connected at a foot end to the support surface with said brace which mast means is pivotally connected at a foot end adjacent an edge of said support surface.

11. A hydraulic exercise device as recited in claim 10 wherein, the brace includes two tubular members maintained in parallel spaced relation, connected at like ends to an edge of the support surface, the opposite tubular member ends joined by a spacer journaled therebetween to rotate about its longitudinal axis; and the mast means is connected at one end to the support-surface near its center, with the other mast means end fixed to said spacer between said brace tubular members.

12. A hydraulic exercise device as recited in claim 10, wherein, the head includes a pair of relatively short tubular sections dimensioned to telescope onto the parallel posts of the mast means, with a pair of laterally extending rods spanning between the upper and lower ends of the short tubular sections.

13. A hydraulic exercise device as recited in claim 1, wherein the mounting means whereto the chest exercise portion is releasably attached provides for vertical and horizontal pivoting at the connection thereto of each of the outstanding arm ends.

* * * * *